United States Patent [19]

Kamuf et al.

[11] Patent Number: 4,611,145

[45] Date of Patent: Sep. 9, 1986

[54] CATHODE RAY TUBE CATHODE WITH CAP AND SLEEVE STRUCTURE

[75] Inventors: Jerry A. Kamuf, Owensboro; Russell L. Arnold, Reynolds Station, both of Ky.

[73] Assignee: Premium Allied Tool, Inc., Owensboro, Ky.

[21] Appl. No.: 653,910

[22] Filed: Sep. 25, 1984

[51] Int. Cl.[4] ..... H01J 29/04; H01J 9/04

[52] U.S. Cl. ..... 313/446; 313/337; 445/50

[58] Field of Search ..... 313/446, 337, 270; 445/36, 50

[56] References Cited

U.S. PATENT DOCUMENTS 2,263,660 11/1941 Vasselli ..... 445/50 X
3,549,929 12/1970 Pappadis ..... 313/37
4,184,100 1/1980 Takanashi et al. ..... 313/337
4,297,612 10/1981 Anezaki et al. ..... 313/270 X
4,478,590 10/1984 Rychlewski ..... 445/50

*Primary Examiner*—Palmer C. DeMeo
*Attorney, Agent, or Firm*—Maurice L. Miller, Jr.

[57] ABSTRACT

An indirectly heated cathode structure for use in cathode ray tubes containing a hollow sleeve of cylindrical shape wherein one edge portion of the sleeve is folded outwardly and backwardly around and against the sleeve. A cap having a circular surface surrounded by a circular sidewall is disposed over the folded edge portion of the sleeve. The sidewall contains an annularly shaped ledge extending around an interior surface portion thereof upon which an end of the folded edge portion of the sleeve rests so as to increase the resistance of the cap to push-off forces applied thereto when the sleeve is restrained. A method for forming the foregoing structure is also disclosed.

3 Claims, 8 Drawing Figures

CATHODE RAY TUBE CATHODE WITH CAP AND SLEEVE STRUCTURE

BACKGROUND OF THE INVENTION

This invention relates in general to elements of cathode ray tubes and more particularly to indirectly heated cathodes for use in the electron gun structure of such tubes.

Cathode ray tubes conventionally employ one or more electron guns having indirectly heated thermionic cathode structures. Such cathodes usually contain a circular cap having a circular sidewall which fits around and engages an end portion of an elongated cylindrically shaped hollow sleeve along the interior of which is disposed an electrical heater element such as a twisted wire. The outer flat surface of the cap is coated with a suitable electron emissive substance. The heating element is energized in a well known manner by application thereof of a suitable d.c. voltage from a remote source, whereby the cap and emissive coating is heated to emit electrons. Typically, such tubes and sleeves are made of Nickel-Chromium alloy and are of thin wall construction. Examples of various prior art electron gun structures employing various arrangements of sleeves and caps are disclosed in U.S. Pat. No. 4,184,100 issued to Y. Takanashi, et al. on Jan. 15, 1980; U.S. Pat. No. 4,297,612 issued to Y. Anezaki on Oct. 27, 1981; and U.S. Pat. No. 3,549,929 issued to N. P. Pappadis on Dec. 22, 1970.

One difficulty that has been encountered using prior art sleeves and caps in indirectly heated cathode structures is that of low mechanical bonding strength between the cap and sleeve. We understand that many of these caps can be forced off the end of their corresponding sleeves by applying a push-off force to the cap while the sleeve is restrained of less than four pounds. Before these parts are molecularly bonded by firing. It would, of course, be highly desirable if the cap push-off strength could be substantially increased above such a level.

Another difficulty that has been encountered using such prior art sleeves and caps is the fact that a sharp or jagged edge on the end of the sleeve over and around which the cap is applied can cause damage to an end portion of the heating element by knicking or scrapping the same as, for example, when the cathode ray tube in which the gun is installed is subjected to vibration or mechanical shock.

By means of our invention, these and other difficulties encountered in the use of prior art sleeve and cap type indirectly heated cathodes are substantially reduced.

SUMMARY OF THE INVENTION

It is an object of our invention to provide a cathode cap and sleeve structure for use in a cathode ray tube electron gun wherein the cap has improved resistance to push-off forces applied thereto while the sleeve to which it is connected is restrained.

It is a further object of our invention to provide a cathode cap and sleeve structure for use in a cathode ray tube electron gun wherein the sleeve has an edge portion which is outwardly folded back upon itself to form a smooth sleeve end which is less likely to damage a heater element inserted in the sleeve when rubbed or struck thereby.

Briefly in accordance with our invention, there is provided a cathode structure for use in cathode ray tubes which includes a hollow sleeve having a cylindrically shaped end portion wherein an edge portion of the cylindrical end portion is folded outwardly and backwardly around and against the outer surface of the sleeve. A circular cap is disposed over the folded edge portion which has a circular sidewall defining an annularly shaped ledge extending in and around an interior surface thereof. A backwardly extending end of the folded edge portion is seated on the ledge thereby increasing the resistance of the cap to being pushed off of the sleeve.

These and other objects, features and advantages of our invention will become apparent to those skilled in the art from the following detailed description and attached drawings upon which, by way of example, only a preferred embodiment of our invention is illustrated.

DESCRIPTION OF THE PREFERRED EMBODIMENT

Figure 1:
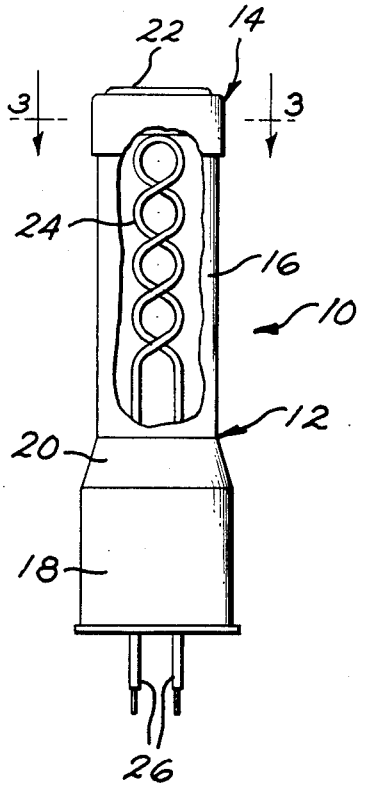
FIG. 1 shows an elevation view of a cathode cap and sleeve assembly such as may be used in a cathode ray tube electron gun with a portion torn away to show a heating element, representing one preferred embodiment of our invention.

Referring now to the drawing figures, there is shown, in one preferred embodiment of our invention, a cathode assembly 10 for use as an electron gun in a cathode ray tube. The assembly 10 includes an elongated generally cylindrically shaped, hollow metal sleeve 12 and a metal end cap 14. In a preferred form, the sleeve 12 contains a front end portion 16 of relatively small diameter and a relatively larger diameter back end portion 18 joined by a tapered central portion 20. As is conventional practice, the cap 14 contains a coating 22 of electron emissive material on its outer flat surface while an insulated, twisted heater wire 24 is disposed within the hollow interior of the sleeve 12. The twisted wire 24 contains two leads 26 which project through the open base of the sleeve 12 for connection to a remote d.c. voltage source, not shown. The wire 24 is thus heated by current flow therethrough from such a source to provide the heat necessary to heat the cap 14 and the emissive coating 22 to produce thermal excitation and emission of electrons from the latter, all in the usual, well known manner.

Figure 2:
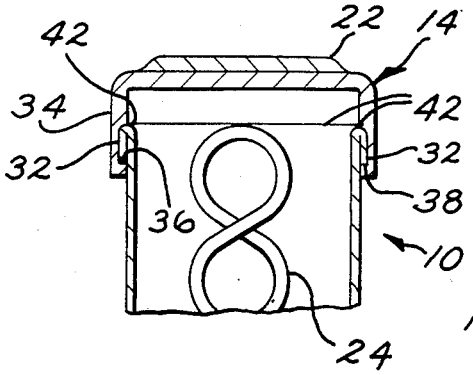
FIG. 2 shows an enlarged view of a fragment of the assembly of FIG. 1 with a forward portion torn away to show the structure of the connection between the cap and sleeve, thus illustrating the preferred form of our invention.
Figure 4:
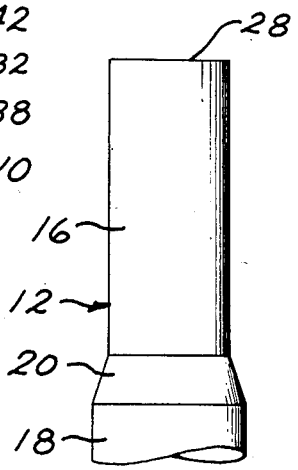
FIGS. 4 and 5 show elevation views of portions of the sleeve of FIGS. 1–3 thus illustrating a particular step in the preparation of the sleeve for connection to the cap.
Figure 3:
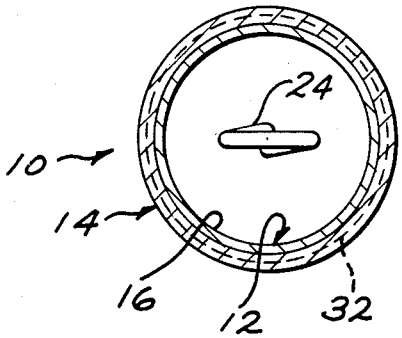
FIG. 3 shows a cross-sectional plan view of the assembly of FIGS. 1–2 as viewed along cross-section lines 3—3 of FIG. 1.
Figure 5:
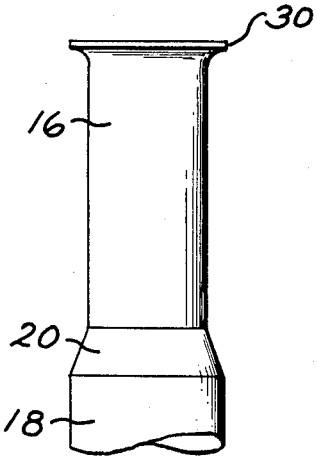
Figure 6:
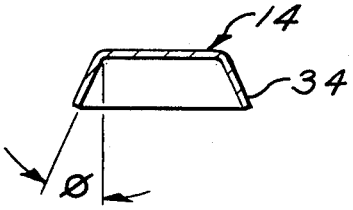
FIG. 6 shows an elevation view of the cap of FIGS. 1–2, the same as viewed in the latter figures with a forward portion of the cap torn away, illustrating the structure of the cap prior to connection to the sleeve.
Figure 7:
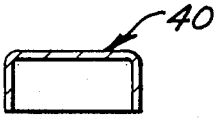
FIG. 7 shows an elevation view of an alternative form of cap suitable for use in the cathode structure of our invention.

Now in accordance with our invention, the basic sleeve 12 as shown in FIG. 4, is subjected to a die operation wherein the forward end 28 is flared 90 degrees outwardly around its periphery to form a flared forward end 30 as shown in FIG. 5. The flared end 30 as shown in FIG. 5 is thereafter subjected to a second die operation to fold the flared end 30 downwardly as viewed to a position flush with the sidewall of the front portion 16 to form a folded forward end portion 32 as shown in FIG. 2. As shown in FIG. 6, the cap 14 may initially contain a diagonally tapered sidewall 34 prior to being press fitted to the folded end portion 32 of FIG. 2. Preferably, the angle of taper of the sidewall 34 with the vertical (the angle $\phi$ as indicated in FIG. 6) is approximately 20 degrees plus or minus 3 degrees. However, we have found that the cap 14 having a tapered sidewall 34 as shown in FIG. 6 does not readily lend itself to use in an automated die stamping process. We, therefore, prefer to use a cap 40 having a vertically extending circular sidewall such as shown in FIG. 7. We also prefer to die stamp the caps 14 and 40 from a suitable nickel-tungsten alloy which can be obtained in rolled strips 0.003 inches thick, $\pm$0.0002 inches from Hamilton Technology, Inc., P. O. Box 4787 Columbia Ave., Lancaster, Pa. 17604. The sleeve 12 may be formed from a suitable Nickel-chrome alloy having a thickness of 0.001 inches, $\pm$0.00005 inches which is also available from Hamilton Technology, Inc. at the above-mentioned address.

After the folded end portion 32 of the sleeve 16 has been formed as previously explained, the cap 14 of FIG. 6 is disposed over and press-fitted around the portion 32 to form a tight interlocking relationship between the sleeve 12 and cap 14 as shown in FIG. 2. The folded end portion 32 is thus mashed into and around the interior surface portion of the sidewall 34 of cap 14 so that a slight ledge 36 in the shape of an annulus is formed around a lower interior surface portion of the sidewall 34 (See FIG. 2) upon which a base 38 of the downwardly folded end portion 32 rests, thus greatly increasing the resistance of the cap 14 to being pulled apart from the sleeve 12.

Referring again to FIG. 2, it will be appreciated that in forming the folded portion 32, an outer edge 42 of the sleeve 12 will be formed which is rounded and smooth rather than rough and jagged. The smooth outer edge 42 is perceived as substantially less likely to knick or scrape the heater wire 24 than would be the case with the outer edge of conventional cathode sleeves.

Most cathode caps and sleeves mated together according to well known prior art methods can not withstand dislodgement when subjected to cap push-off forces in excess of four pounds. By contrast, cathode caps and sleeves assembled according to our invention have demonstrated the ability to successfully resist breaking apart and have remained securely fastened together when subjected to cap push-off forces of up to at least ten pounds.

Figure 8:
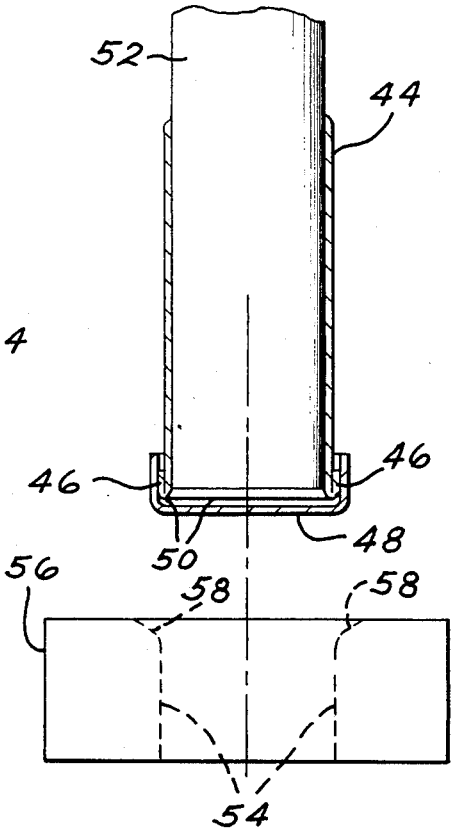
FIG. 8 shows a side elevation view of the cap of FIG. 7 disposed over a cylindrical end portion of a hollow sleeve containing a cylindrically shaped punch preparatory to insertion of the cap and sleeve into a die to secure the cap to the sleeve.

Referring now to FIG. 8, there is shown a cylindrically shaped end portion of a hollow sleeve 44 having an outwardly and backwardly folded end portion 46 extending flush around the outer sidewall of said sleeve. A cap 48, similar to the cap 40 of FIG. 7, is disposed over a rounded end 50 of the sleeve 44 resulting from the formation of the folded end portion 46. The sleeve 44 contains a cylindrically shaped punch 52 inserted therethrough to form interior support for the sleeve as the cap 48 is mashed inwardly against the folded portion 46. The assembly thus described is shown preparatory to insertion into a hollow cylindrically shaped shaft 54 of a die element 56 wherein the sidewall of the cap 48 will be mashed inwardly as aforesaid so as to press the folded portion 46 into the interior surface of the sidewall to form an annularly shaped ledge, similar to ledge 36 of FIG. 2, against which the end of the folded portion 46 will rest. The entrance to the shaft 54 should be a smoothly radiused peripheral edge portion 58 to facilitate the guiding of the cap 48 therein. In this manner, the cap 48 is secured to the sleeve 44 so as to have greatly improved resistance to cap push-off forces applied thereto while the sleeve is restrained.

Although the subject invention has been described with respect to specific details of a single preferred embodiment thereof, it is not intended that such details limit the scope of my invention otherwise than as expressly set forth in the following claims.

We claim:

1. A cathode structure for use in cathode ray tubes comprising a hollow metallic sleeve having a cylindrically shaped end portion wherein an edge portion of said cylindrical end portion is folded outwardly and backwardly around and against an outer surface of said sleeve, and a circular metallic cap disposed over said folded edge portion and having a circular sidewall defining an annularly shaped ledge extending in and around an interior surface thereof, a backwardly extending edge of said folded edge portion being seated on said ledge, thereby to increase the resistance of said cap to being pushed off of said sleeve.

2. The structure of claim 1 wherein said folded edge portion forms a smooth rounded end on said sleeve, thereby to reduce the likelihood of damaging a heater element when and after the latter is inserted into said sleeve which might otherwise result when said heater element and end of said sleeve touch, rub or strike one another.

3. A method of forming a cathode structure for use in cathode ray tubes comprising providing a hollow metallic sleeve having a cylindrically shaped end portion, folding an edge portion of said cylindrical end portion outwardly and downwardly around an outer surface of said sleeve to form a rounded end on said sleeve, providing a metallic cap having a circular surface surrounded by a circular sidewall, disposing said cap over the rounded end and folded edge portion of said sleeve, and mashing the sidewall of said cap inwardly against said folded end portion to deform an interior surface of said sidewall and thus form an annular ledge in said sidewall upon which the end of said folded end portion will seat so as to increase the resistance of said cap to being pushed off the end of said sleeve.

* * * * *